US007177558B2

(12) United States Patent
Tanaka et al.

(10) Patent No.: US 7,177,558 B2
(45) Date of Patent: Feb. 13, 2007

(54) IMAGE FORMING APPARATUS AND CALIBRATION METHOD

(75) Inventors: Satoshi Tanaka, Ebina (JP); Matsuyuki Aoki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 125 days.

(21) Appl. No.: 10/935,110

(22) Filed: Sep. 8, 2004

(65) Prior Publication Data

US 2005/0117927 A1 Jun. 2, 2005

(30) Foreign Application Priority Data

Dec. 2, 2003 (JP) ..... 2003-402812

(51) Int. Cl.
*G03G 15/01* (2006.01)
*G03G 15/00* (2006.01)

(52) U.S. Cl. ..... 399/39; 399/45; 399/49

(58) Field of Classification Search ..... 399/15, 399/39, 40, 41, 45, 49, 389; 358/1.9, 504, 358/518

See application file for complete search history.

(56) References Cited

U.S. PATENT DOCUMENTS 5,508,826 A * 4/1996 Lloyd et al. ..... 358/504 X
5,809,366 A * 9/1998 Yamakawa et al. ..... 399/39
5,852,462 A * 12/1998 Lloyd et al. ..... 399/45 X
5,956,044 A * 9/1999 Giorgianni et al. ..... 358/518 X
6,178,007 B1 1/2001 Harrington
6,349,185 B1 * 2/2002 Burkes et al. ..... 399/49
6,519,425 B2 * 2/2003 Fischer ..... 399/49

FOREIGN PATENT DOCUMENTS

JP 02-169272 * 6/1990
JP B2 3150305 1/2001

* cited by examiner

*Primary Examiner*—Sandra L. Brase
(74) *Attorney, Agent, or Firm*—Oliff & Berridge, PLC

(57) ABSTRACT

An image forming apparatus for continuously printing plural images has an empirical calibration part that performs color calibration processing based on a test image printed on recording paper, a predictive calibration part that performs color calibration processing based on a reference value that has been determined in advance, and a controller that allows the empirical calibration part and the predictive calibration part to perform color calibration processing. In the case where recording paper is switched and plural images are printed, the controller allows the empirical calibration part to perform color calibration processing when predetermined type of recording paper is used, and allows the predictive calibration part to perform color calibration processing when recording paper of other type is used.

20 Claims, 9 Drawing Sheets

FIG. 2A

PRINTING REQUEST DATA

| | | |
|---|---|---|
| JOB 1 | PAPER A (HEAVY PAPER) | IMAGE DATA #01 (ONE) |
| JOB 2 | PAPER B (COATED PAPER) | IMAGE DATA #02 TO #09 (ONE FOR EACH) |
| JOB 3 | PAPER C (PLAIN PAPER) | IMAGE DATA #10 TO #50 (ONE FOR EACH) |
| JOB 4 | PAPER A (HEAVY PAPER) | IMAGE DATA #51 (ONE) |

FIG. 2B

| | | |
|---|---|---|
| JOB 3.1 | SCREEN A | IMAGE DATA #10 TO #20 (ONE FOR EACH) |
| JOB 3.2 | SCREEN A<br>SCREEN B | IMAGE DATA #21 TO #23 (ONE FOR EACH) |
| JOB 3.3 | SCREEN A | IMAGE DATA #24 TO #50 (ONE FOR EACH) |

FIG. 4

| PAPER | SCREEN | TEST IMAGE | DIFFERENCE DATA | CALIBRATION VALUE |
|---|---|---|---|---|
| PAPER 1 | SCREEN 1 | NO. 0012 | AAA TO BBB | +aaa |
| | | | BBB TO CCC | +bbb |
| | | | ... | ... |
| PAPER 2 | SCREEN 2 | NO. 0014 | AAA TO BBB | +fff |
| | | | BBB TO CCC | +ggg |
| ⋮ | ⋮ | ⋮ | ⋮ | ⋮ |

CONDITION OF RECORDING PAPER: L2 < L1

IMAGE FORMING APPARATUS AND CALIBRATION METHOD

BACKGROUND OF THE INVENTION

1. Field of the Invention

The present invention relates to an image forming apparatus for performing color calibration.

2. Description of the Related Art

It is known to provide an image processing method, when calibration is necessary to be performed during continuous formation of n sheets of images, for suspending image forming processing and executing calibration processing, and, after the calibration processing, restarting the image forming processing. Further, it is known to provide a method for printing color patches at regular intervals during use of a printer, detecting the color patches by a sensor, and determining a color calibration value based on the detected colors.

The present invention is achieved out of the above described background, and provides an image forming apparatus for realizing good color calibration.

SUMMARY OF THE INVENTION

An image forming apparatus according to an aspect of the invention includes: an image forming part that forms an image on a recording medium; a first calibration part that performs color calibration processing based on the image formed on the recording medium; a second calibration part that performs color calibration processing based on a reference value that has been determined in advance; a medium supply part that supplies any one recording medium from plural kinds of recording media to the image forming part; and a controller that permits color calibration processing by the first calibration part when at least one kind of recording medium is supplied by the medium supply part, and inhibits the color calibration processing by the first calibration part and permits color calibration processing by the second calibration part when at least another kind of recording medium is supplied by the medium supply part.

Further, an image forming apparatus according to another aspect of the present invention includes: an image forming part that forms an image on a recording medium; a calibration part that performs first color calibration processing based on the image formed on the recording medium and second color calibration processing based on a reference value that has been determined in advance; a medium supply part that supplies any one recording medium from plural kinds of recording media to the image forming part; and a controller that permits the first color calibration processing with respect to at least one kind of recording medium supplied by the medium supply part, and inhibits the first color calibration processing and permits the second color calibration processing with respect to at least another kind of recording medium supplied by the medium supply part to the calibration part.

Further, an image forming apparatus according to an aspect of the present invention is an image forming apparatus for executing image forming processing including plural units of processing, and the apparatus includes: an image forming part that forms plural images by sequentially executing the plural units of processing; a calibration part that performs color calibration processing based on an image formed on a recording medium; and a controller that controls the calibration part to perform at least a part of color calibration processing for a subsequent unit of processing in parallel with the unit of processing that is being executed by the image forming part.

Further, an image forming apparatus according to another aspect of the present invention is an image forming apparatus for executing image forming processing including plural units of processing, and the apparatus includes: an image forming part that forms an image on a recording medium by sequentially executing the plural units of processing; a controller that controls the image forming part to allow processing of forming an image for color calibration used in color calibration processing for a subsequent unit of processing to interrupt the unit of processing that is being executed; and a calibration part that performs color calibration processing based on the image for color calibration formed on the recording medium.

Further, a calibration method according to another aspect of the present invention includes: forming an image on a recording medium; and performing first color calibration processing based on the image formed on the recording medium with respect to at least one kind of recording medium, and performing second color calibration processing based on a reference value that has been determined in advance with respect to at least another kind of recording medium.

Further, a calibration method according to another aspect of the present invention is a calibration method of an image forming apparatus for executing image forming processing including plural units of processing, and the method includes: sequentially executing the plural units of processing; and performing at least a part of color calibration processing for a subsequent unit of processing in parallel with the unit of processing that is being executed.

Further, a calibration method according to another aspect of the present invention is a calibration method of an image forming apparatus for executing image forming processing including plural units of processing, and the method includes: forming an image on a recording medium by sequentially executing the plural units of processing; allowing forming processing of an image for color calibration used in color calibration processing for a subsequent unit of processing to interrupt the unit of processing that is being executed; and performing color calibration processing based on the image for color calibration formed on the recording medium.

Further, a calibration method according to the present invention is a calibration method of an image forming apparatus for forming an image on a recording medium, and the method includes: forming an image for color calibration on the recording medium before continuous image forming processing is started; performing color calibration processing based on the image for color calibration formed on the recording medium; and performing color calibration processing based on a reference value that has been determined in advance after the continuous image forming processing is started.

BRIEF DESCRIPTION OF THE DRAWINGS

Embodiments of the present invention will be described in detail based on the following figures, wherein:

FIGS. 2A and 2B illustrate printing request data input to an image processing unit 20;

FIG. 4 illustrates a calibration table to be referred to when a calibration value determination part 234 determines a calibration value;

FIG. 5A illustrates the case where the color calibration processing is performed regardless of the switching of jobs and FIG. 5B illustrates the case where the color calibration processing is performed in response to the switching of jobs;

DETAILED DESCRIPTION OF THE INVENTION

As below, a first embodiment of the invention will be described.

First, a printer 10 to which the invention is applied will be described.

Figure 1:
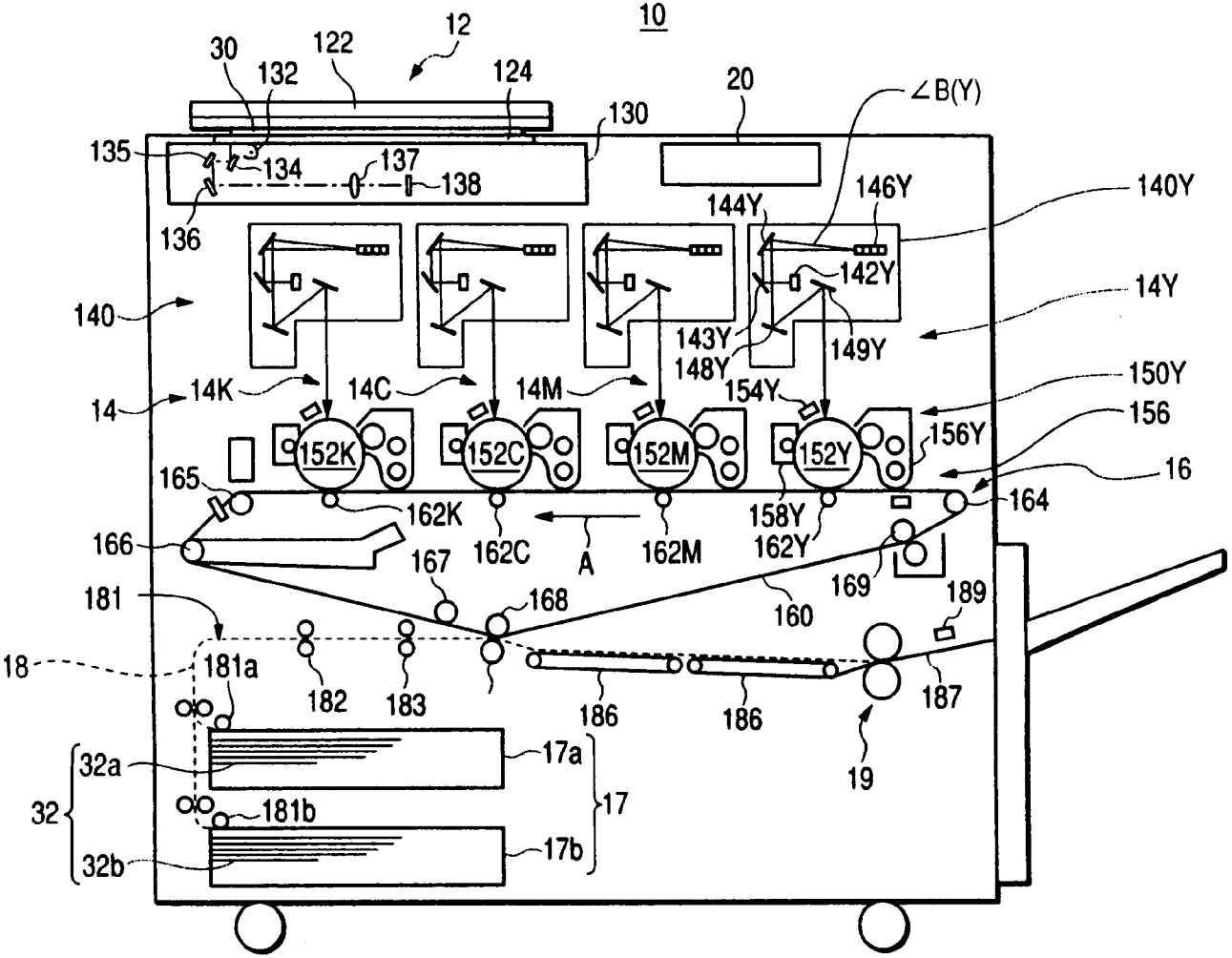
FIG. 1 shows the constitution of a tandem type printer (image forming apparatus) 10.

FIG. 1 shows the constitution of a tandem type printer (image forming apparatus) 10.

As shown in FIG. 1, the printer 10 has an image reading unit 12, an image forming unit 14, an intermediate transfer unit 16, plural paper trays 17, a paper feed path 18, a fixing unit 19, and an image processing unit 20. This printer 10 may be a complex machine having, in addition to a printer function for printing image data received from a personal computer (not shown) or the like, a combination of a function as a full color copier using the image reading unit 12 and a function as a facsimile. Note that, in the embodiment, the tandem type printer 10 in which plural photoconductor drums 152 are provided will be described as a specific example, however, not limited to that, for example, a printer in which only one photoconductor drum 152 is provided may be adopted.

First, the printer 10 will be outlined below. At the top of the printer 10, the image reading unit 12 and the image processing unit 20 are provided and they function as an input part of image data. The image reading unit 12 reads an image indicated on an original 30 and outputs it to the image processing unit 20. The image processing unit 20 performs image processing such as tone correction, resolution correction, or the like on the image data input from the image reading unit 12 and the image data input from a personal computer (not shown) or the like via a network line such as LAN and outputs the data to the image forming unit 14.

Below the image reading unit 12, the plural image forming units 14 are provided corresponding to colors forming a color image. In this example, a first image forming unit 14Y, a second image forming unit 14M, a third image forming unit 14C, and a fourth image forming unit 14K corresponding to the respective colors of yellow (Y), magenta (M), cyan (C), and black (K) are horizontally arranged spaced at regular intervals along the intermediate transfer unit 16. The intermediate transfer unit 16 turns an intermediate belt 160 as an intermediate body in a direction of an arrow A in the drawing, and these four image forming units 14Y, 14M, 14C, and 14K form toner images of the respective colors based on the image data input from the image processing unit 20 and transfers (primary transfer) on the intermediate belt 160 with timing of superposing these plural toner images on each other. By the way, the order of colors of the respective image forming units 14Y, 14M, 14C, and 14K are not limited to the order of yellow (Y), magenta (M), cyan (C), and black (K), but the order is arbitrary, such that the order of black (K), yellow (Y), magenta (M), and cyan (C).

The paper feed path 18 is provided below the intermediate transfer unit 16. Recording paper 32*a* or 32*b* supplied from a first paper tray 17*a* or a second paper tray 17*b* is carried on the paper feed path 18, the toner image of the respective colors multiple transferred on the intermediate belt 160 are transferred (secondary transferred) at one time on the paper, the transferred toner images are fixed by the fixing unit 19, and the paper is discharged to the outside.

Next, the respective units of the printer 10 will be described in detail.

As shown in FIG. 1, the image reading unit 12 has a platen glass 124 for mounting the original 30, a platen cover 122 for pressing the original 30 against the platen glass 124, and an image reader 130 for reading an image of the original 30 mounted on the platen glass 124. This image reader 130 is arranged so as to illuminate the original 30 mounted on the platen glass 124 by a light source 132, scan the reflected light image from the original 30 on an image reading device 138 consisting of an CCD or the like to expose the element via a reducing optical system including a full-rate mirror 134, a first half-rate mirror 135, a second half-rate mirror 136, and an imaging lens 137, and read the color material reflected light image of the original 30 in predetermined dot density (e.g., 16 dot/mm) by the image reading device 138.

The image processing unit 20 performs predetermined image processing such as shading correction, original displacement correction, brightness/color space conversion, gamma correction, frame erase, and color/movement edit on the image data read by the image reading unit 12. Note that the color material reflected light image of the original 30 read by the image reading unit 12 is original reflectance data of three colors of red (R), green (G), and blue (B) (8 bits for each), for example, and, the data is converted into original color material tone data (raster data) of four colors of yellow (Y), magenta (M), cyan (C), and black (K) (8 bits for each) by the image processing by the image processing unit 20.

The first image forming unit 14Y, the second image forming unit 14M, the third image forming unit 14C, and the fourth image forming unit 14K are horizontally arranged spaced at regular intervals side by side, and they have nearly the same constitution except that they are different in colors of the forming images. Accordingly, as below, the first image forming unit 14Y will be described. Note that the constitutions of the respective image forming units are distinguished by assigning Y, M, C, or K.

The image forming unit 14Y has a light scanning device 140Y for scanning a laser beam in response to the image data input from image processing unit 20 and an image forming device 150Y in which an electrostatic latent image is formed by the laser beam scanned by the light scanning device 140Y.

The light scanning device 140Y modulates a semiconductor laser 142Y in response to image data of yellow (Y) and outputs a laser beam LB (Y) from the semiconductor laser 142Y in response to the image data. The laser beam LB (Y) output from the semiconductor laser 142Y is applied to a rotating polygonal mirror 146Y via a first reflecting mirror 143Y and a second reflecting mirror 144Y, deflected and scanned by the rotating polygonal mirror 146Y, and applied onto a photoconductor drum 152Y of the image forming device 150Y via the second reflecting mirror 144Y, a third reflecting mirror 148Y, and a fourth reflecting mirror 149Y.

The image forming device 150Y includes the photoconductor drum 152Y as an image carrier rotating along the direction of the arrow A at a predetermined rotational speed, a primary charging scorotron 154Y as a charging part for charging the surface of the photoconductor drum 152Y uniformly, a developing device 156Y for developing the electrostatic latent image formed on the photoconductor drum 152Y, and a cleaning device 158Y The photoconductor drum 152Y is charged uniformly by the primary charging scorotron 154Y, and an electrostatic latent image is formed thereon by the laser beam LB (Y) applied by the light scanning device 140Y. The electrostatic latent image formed on the photoconductor drum 152Y is developed by the developing device 156Y with toner of yellow (Y), and transferred to the intermediate transfer unit 16. The residual toner, paper dust, or the like adhering to the photoconductor drum 152Y after the transfer step of the toner image is removed by the cleaning device 158Y.

Other image forming units 14M, 14C, and 14K similarly form toner images of the respective colors of magenta (M), cyan (C), and black (K) and transfer the formed respective color toner images onto the intermediate transfer unit 16 as described above.

The intermediate transfer unit 16 has the intermediate transfer belt 160 (image carrier) pulled with a fixed tension between a drive roll 164, a first idle roll 165, a steering roll 166, a second idle roll 167, a backup roll 168, and a third idle roll 169. The drive roll 164 is rotationally driven by a drive motor (not shown), and thereby, the intermediate transfer belt 160 is circularly driven at a predetermined speed in the direction of the arrow A. The intermediate transfer belt 160 is formed in an endless belt shape by, for example, forming a synthetic resin film such as polyimide having flexibility in a strip shape and connecting both ends of the strip-shaped synthetic resin film by welding or the like.

Further, the intermediate transfer unit 16 has a first primary transfer roll 162Y, a second primary transfer roll 162M, a third primary transfer roll 162C, and a fourth primary transfer roll 162K in positions opposed to the respective image forming units 14Y, 14M, 14C, and 14K, and multiple-transfers the toner images of the respective colors formed on the photoconductor drums 152Y, 152M, 152C, and 152K by these primary transfer rolls 162Y, 162M, 162C and 162K onto the intermediate transfer belt 160. Note that the residual toner adhering to the intermediate transfer belt 160 is removed by a cleaning blade or brush of a belt cleaning unit provided at the downstream side of a secondary transfer position.

In the paper feed path 18, a first paper feed roller 181*a* and a second paper feed roller 181*b* for drawing the first recording paper 32*a* or second recording paper 32*b* from the first paper tray 17*a* or a second paper tray 17*b*, a pair of paper feed rollers 182, and a resist roll 183 for feeding the first recording paper 32*a* and 32*b* with predetermined timing to the secondary transfer position are provided.

Further, in the secondary transfer position on the paper feed path 18, a secondary transfer roll 185 in pressing contact with the backup roll 168 is provided. The toner images of the respective colors multiple-transferred onto the intermediate transfer belt 160 are secondary-transferred onto the recording paper 32*a* or 32*b* by the pressing contact force by the secondary transfer roll 185 and electrostatic force. The recording paper 32*a* or 32*b* on which the toner images of the respective colors have been transferred is carried by two carrying belt 186 to the fixing unit 19.

The fixing unit 19 performs heating treatment and pressing treatment on the recording paper 32*a* or 32*b* on which the toner images of the respective colors have been transferred, and thereby, fuses and fixes the toner onto the recording paper 32*a* or 32*b*.

The recording paper 32*a* or 32*b* that has been subjected to fixing treatment (heating and pressing) by a fixing unit 19 is discharged to the outside of the printer 10 through a discharge path 187 (carrying path) provided in a subsequent stage of the fixing unit 19, and stacked on a discharge tray. Further, in the discharge path 187, a colorimetric sensor 189 (detecting part) is provided. The colorimetric sensor 189 reads an image on the recording paper 32*a* or 32*b* and measures an amount of characteristic of the image. The amount of characteristic measured by the calorimetric sensor 189 is color data (density, saturation, hue, color distribution, etc. of the respective colors), for example.

Next, the background on which the invention is achieved and the outline of the embodiment will be described.

The printer 10 sometimes prints plural images continuously in response to a printing request from a user. In the case where the printer 10 prints plural images continuously, because of environmental changes or device characteristics variations during printing, density or tone reproducibility of the printed image changes and image quality varies between plural images printed according to the same printing request.

Accordingly, the printer 10 forms a test image when printing images continuously, and performs color calibration processing based on the test image. Here, the color calibration processing includes empirical calibration processing (first calibration processing) based on a test image printed on recording paper and predictive calibration processing (second calibration processing) based on a reference value calculated in advance. The empirical calibration processing includes test image printing processing for printing a test image, difference detection processing for detecting a difference between reference apparatus characteristics and current device characteristics, adjustment processing for adjusting the apparatus characteristics based on a result of the difference detection processing, and the like. Further, the prediction color correction processing includes processing for reading a reference value (e.g., a result of the difference detection processing) that has been calculated in advance based on the test image printed on the recording paper, prediction processing based on the read reference value, adjustment processing of the apparatus characteristics based on a result of the prediction processing, and the like.

By the way, it is conceivable that calibration processing is performed based on the toner images on the photoconductor drums 152K, 152C, 152M and 152Y or intermediate transfer belt 160. However, since the toner image formed on the photoconductor drums 152K, 152C, 152M and 152Y is in single color, it is difficult to predict the color formed by the overlapping plural colors of toner based thereon. Further, since, when the toner image is fused and fixed onto the recording paper 32, the surface characteristics of the recording paper 32, the order in which the plural color toner images overlap, and properties of the toner, etc. are mutually related, it is difficult to perform sufficient color calibration based on the toner images formed on the intermediate transfer belt 160 or the like. Therefore, it is desired that the printer 10 performs color calibration processing based on the toner image formed on the recording paper 32. More preferably, the printer 10 performs color calibration processing based on the toner image fixed on the recording paper 32. That is, the printer 10 in the embodiment performs the above described empirical calibration processing.

Further, in the printer 10, when continuous printing processing is requested by the user, when the empirical calibration processing is allowed to interrupt the continuous printing processing at regular time intervals, printing processing of a test image or the like is allowed to interrupt, and thereby, the printing processing requested by the user is delayed (that is, productivity is degraded). Especially, since the result of the empirical calibration processing differs depending on the combination of recording paper and a screen, it is desired that the printer 10 performs empirical calibration processing with respect to every combination, however, when the empirical calibration processing is performed with respect to every combination during printing processing, the productivity is largely degraded.

Accordingly, the printer 10 in the embodiment maintains productivity by appropriately switching between the empirical calibration processing with high calibration accuracy and the predictive calibration processing with less delay of printing processing due to calibration processing. For example, the printer 10 performs empirical calibration processing when one kind of recording medium is used for printing processing, and predictive calibration processing when another kind of recording medium is used for printing processing. Further, the printer 10 performs empirical calibration processing before continuous printing processing is started, and, after the continuous printing processing is started, mainly performs predictive calibration processing based on the reference value determined by the empirical calibration processing.

FIGS. 2A and 2B illustrate printing request data input to the image processing unit 20.

As illustrated in FIGS. 2A and 2B, the image processing unit 20 acquires printing request data including plural jobs from a user interface device of the printer 10 or a personal computer. That is, the printing request data is a printing instruction input by the user to the printer 10, divided into plural jobs as units of processing of the printer 10 and input to the image processing unit 20 by the personal computer or a controller (not shown) of the printer 10. Here, a job is a unit of processing printable in the same operation mode by the image forming unit 14 or the intermediate transfer unit 16, and, in this example, a job is a unit of processing sectioned at the time when the kind of recording paper 32 and the screen or one of them is switched. That is, when the kind of recording paper 32, the screen, or the like is switched, the image forming unit 14, the intermediate transfer unit 16, or the like prints an image by switching the operation mode. Further, an operation mode is an operation type (operation pattern) of the respective components of the printer 10 such as the image forming unit 14 or the intermediate transfer unit 16, and set based on the size or weight of the recording paper 32, the kind of image (color/monochrome), image resolution, or designation by the user (user selection mode). Note that, as for "the kind of recording paper 32" in the embodiment, kinds are distinguished as being different from each other not only when materials and surface characteristics are different from each other, but also when the thickness, the weight, size, or the like of recording paper is different from each other even if the materials or the like are the same with each other.

The printing request data input by the user is divided into plural jobs according to the kind of recording paper 32 (plain paper, heavy paper, or coated paper) to be printed with image data thereon as shown in FIG. 2A, and further divided into plural jobs according to the screen (including screen combination) applied to the image data as shown in FIG. 2B. The screen is selected by the image processing unit 20 depending on attributes of images included in one image (picture image, character image, line image, etc.). The screen may be selected by the image processing unit 20 in response to the designation by the user. Further, the printer 10 may acquire image data that has been subjected to screen processing in advance from the user.

When the printing request data is input, the printer 10 processes the respective jobs continuously, and prints images based on the image data of the respective jobs.

Figure 3:
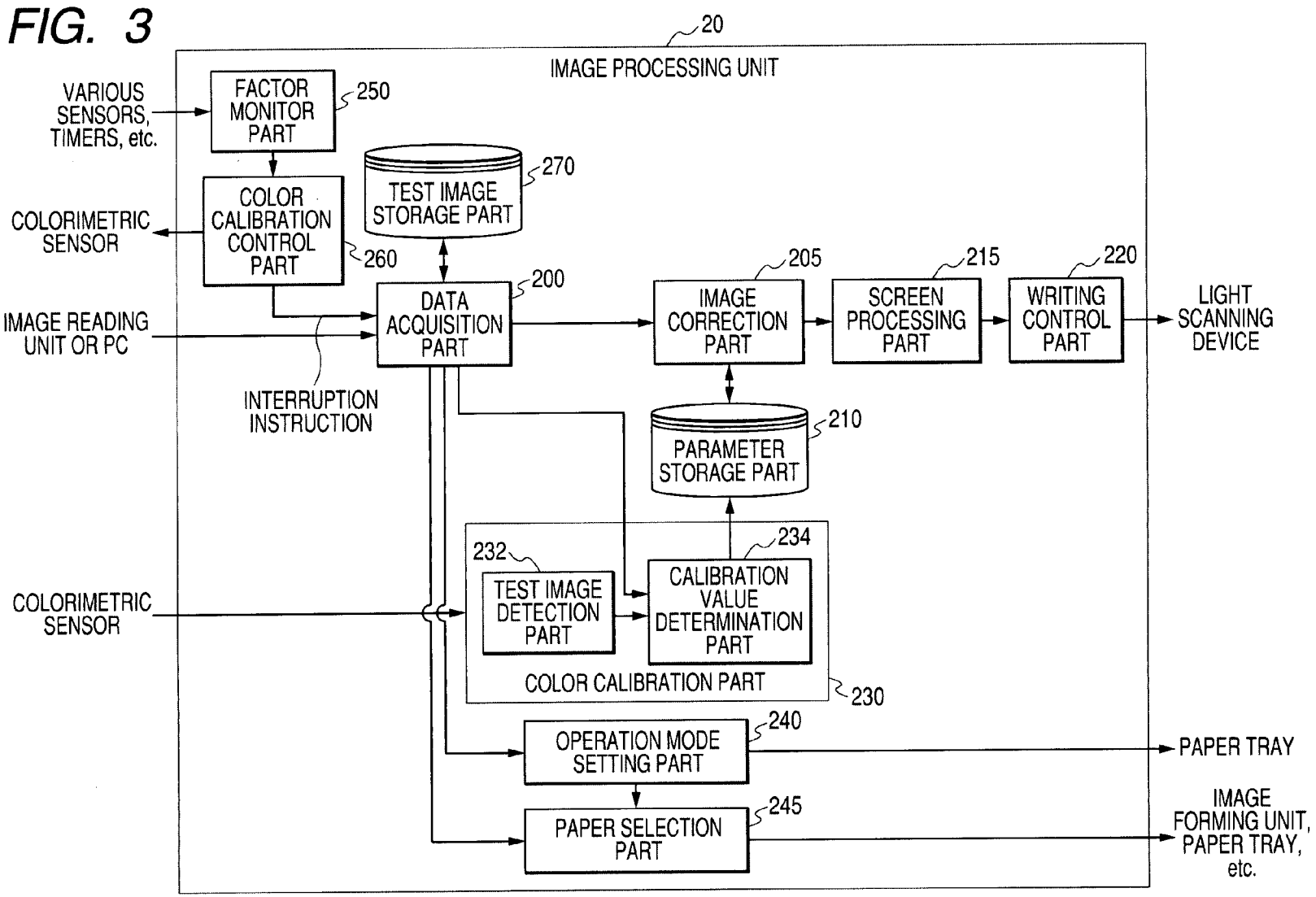
FIG. 3 illustrates the functional constitution of the image processing unit 20.

FIG. 3 illustrates the functional constitution of the image processing unit 20.

As illustrated in FIG. 3, the image processing unit 20 has a data acquisition part 200, an image correction part 205, a parameter storage part 210, a screen processing part 215, a writing control part 220, a color calibration part 230, an operation mode setting part 240, a paper selection part 245, a factor monitor part 250, a color calibration control part 260, and a test image storage part 270. Further, the color calibration part 230 includes a test image detection part 232 and a calibration value determination part 234.

Note that the above described respective components included in the image processing unit 20 may be realized by either software or hardware.

The data acquisition part 200 acquires printing request data including image data from the image reading unit 12 (FIG. 1) or a personal computer of the user, outputs the acquired image data to the image correction part 205, and outputs information for designating recording paper (hereinafter, referred to as "medium designation information") to the paper selection part 245. Further, the data acquisition part 200 outputs information for defining an operation mode such as the kind of recording paper and screen of the respective jobs corresponding to the respective jobs included in the printing request data to the operation mode setting part 240.

Further, the data acquisition part 200 reads out test image data from the test image storage part 270 according to the control by the color calibration control part 260, outputs the read test image data to the image correction part 205, and outputs information for identifying the test image data to the calibration value determination part 234.

The image correction part 205 performs tone correction processing and sharpness correction processing on the image data input from the data acquisition part 200 and outputs the data to the screen processing part 215. In this case, the image correction part 205 refers to a look-up table stored in the parameter storage part 210 and determines amounts of correction of the tone correction processing and sharpness correction processing. The parameter storage part 210 has stored correction coefficients used for each correction processing such as tone correction processing and sharpness correction processing, and the image correction part 205 corrects the input image data based on the correction coefficients stored in the parameter storage part 210 so that the data may be reproduced in a desired colors and sharpness on the recording paper 32.

The screen processing part 215 performs screen processing on the (multi-valued) image data input from the image correction part 205 to convert it into binary image data and outputs the data to the writing control part 220. The screen processing part 215 switches the screen depending on the image attributes (picture image, character image, line image, etc.). For example, when an image area of picture image and an image area of character image are mixed in one page of image, the screen processing part 215 switches the screen with respect to each of these image areas.

The writing control part 220 controls the light scanning device 140 (FIG. 1) in response to the (binary) image data input from the screen processing part 215. For example, the writing control part 220 generates a pulse signal in response to the input image data and outputs the pulse signal to the light scanning device 140 to blink the light scanning device 140.

In the color calibration part 230, the test image detection part 232 controls the calorimetric sensor 189 (FIG. 1) and reads the test image printed on the recording paper 32 to measure the amount of characteristic of the test image. The test image detection part 232 outputs the measured amount of characteristic to the calibration value determination part 234.

The calibration value determination part 234 performs color calibration processing based on the test image printed on the recording paper 32 (i.e., empirical calibration processing) or color calibration processing based on the reference value that has been determined in advance (i.e., predictive calibration processing). Specifically, the calibration value determination part 234 determines a calibration value by comparing the amount of characteristic input from the test image detection part 232 with the reference value (fixed value) as a target value of the color calibration processing as the empirical calibration processing and updates the look-up table stored in the parameter storage part 210 in response to the color calibration value. That is, the calibration value determination part 234 determines the calibration value of the apparatus based on the amount of characteristic input from the test image detection part 232 and adjusts the color of the image to be output from the printer 10 in response to the calibration value. Especially, it is desired that the test image detection part 232 measures the amount of characteristic with respect to the color developed by the plural kinds of toner, and the calibration value determination part 234 determines the color calibration value based on the amount of characteristic by the plural kinds of toner.

Further, the calibration value determination part 234 calculates a predictive value of the color calibration value based on the reference value that has been determined (color calibration value determined by the empirical calibration processing, the amount of characteristic used in the empirical calibration processing, time varying amounts of these, or the like) as predictive calibration processing and updates the look-up table stored in the parameter storage part 210 in response to the predictive value. Here, the predictive calibration processing includes prediction of a required color calibration value with a state of the precedent checkpoint (e.g., at the start of a job or at the time of previous color calibration processing) as a target and prediction of an amount of color variation (or color calibration value) based on the amount of color variation (or color calibration value) relating to another recording paper and screen.

By the way, in the embodiment, the color calibration part 230 updates the look-up table stored in the parameter storage part 210 for the color calibration of the printer 10, however, not limited to that, for example, the color calibration of the printer 10 may be realized by adjusting the secondary transfer processing (pressing contact force or electrostatic force) by the secondary transfer roll 185 or adjusting the fixing treatment (heat temperature or pressure) by the fixing unit 19 to adjust the developed color of the image formed on the recording paper 32.

The operation mode setting part 240 determines the operation mode based on mode defining information input from the data acquisition part 200 and allows the image forming unit 14 (FIG. 1), the intermediate transfer unit 16, etc. to operate in the determined operation mode. Here, the operation mode is an operation pattern of the component part included in the printer 10, and plural operation patterns are prepared in advance to each of the image forming unit 14 (FIG. 1), the intermediate transfer unit 16, and the resist roll 183, for example. In this example, the operation mode setting part 240 sets an operation mode for controlling the process speed of the image formation based on the mode defining information. For example, the operation mode setting part 240 controls intervals of toner images to be transferred onto the intermediate transfer belt 160 and feed timing of the recording paper 32 by the resist roll 183 in response to the size of the image to be output (e.g., the size of the recording paper 32). Further, the operation mode setting part 240 controls the writing speed by the light scanning device 140 and the rotational speed of the photoconductor drum 152 and the intermediate transfer belt 160 in response to the resolution of the image to be output.

The paper selection part 245 controls the paper tray 17 and the paper feed roller 181 to select one piece of recording paper 32 from the plural kinds of recording paper (in this example, the recording paper 32*a* or the recording paper 32*b*) and supply the selected recording paper 32 to the paper feed path 18. For example, the paper selection part 245 selects recording paper 32 in response to the instruction of the user when an image in response to the request by the user is printed, and selects recording paper 32 as a target of color calibration (i.e., recording paper used in the subsequent job) when a test image for the color calibration is printed.

The factor monitor part 250 judges whether an output from a timer for measuring the elapsed time, a counter for measuring the number of printed sheets, a remaining amount sensor for detecting the remaining amount of toner, an environment sensor for detecting the amount of environmental variations in temperature, humidity, or the like, a density sensor for detecting density of the toner image formed on the intermediate transfer belt 160, or the like falls within a predetermined range or not, and, in the case where it falls outside of the range, notifies the color calibration control part 260 to perform the empirical calibration processing, and, in the case other than that, notifies it to prohibit the empirical calibration processing and perform the predictive calibration processing.

Since the empirical calibration processing includes printing processing of a test image etc., the productivity (printing speed) of the printer 10 is affected. Accordingly, the printer 10 can minimize the effect on the productivity by monitoring the factor that varies the color of an image to be printed on the recording paper 32 and performing empirical calibration processing only in the case where the variation factor of the color exceeds the acceptable range.

The color calibration control part 260 controls the color calibration processing in the printer 10. Specifically, when plural jobs are continuously proceeding, the color calibration control part 260 allows the empirical calibration processing in response to the switching of jobs and the predictive calibration processing during job execution to be performed, respectively, and in the case other than that, allows the empirical calibration processing to be performed with predetermined timing (at the time when the power is on, at the start of the first job, or the like). In the embodiment, when notified to perform the empirical calibration processing from the factor monitor part 250, the color calibration control part 260 instructs the data acquisition part 200 to allow the empirical calibration processing to interrupt at the time when the job is switched, and, in the case other than that, instructs the calibration value determination part 234 to perform the predictive calibration processing in parallel with the ongoing job. Further, when the empirical calibration processing is performed, the color calibration control part 260 controls the colorimetric sensor 189 to read the test image printed on the recording paper 32.

The test image storage part 270 has stored the data of test images used for the color calibration processing in advance. The data acquisition part 200 instructed to allow the empirical calibration processing to interrupt reads out the data of test images from the test image storage part 270 and outputs the data to the image correction part 205. By the way, in this example, the printer 10 prints the test image that has been prepared for the color calibration in advance, however, not limited to that, for example, a part or whole of image data requested to be printed by the user (i.e., image data included in printing request data) may be printed as a test image for use for the color calibration.

FIG. 4 illustrates a calibration table to be referred to when the calibration value determination part 234 determines a calibration value.

As illustrated in FIG. 4, the calibration value determination part 234 has a calibration table for relating the kind of recording paper 32, the kind of screen, test images, and difference data to calibration values. The difference data is data representing the difference between the amount of characteristic read from the test image printed on the recording paper and the reference amount of characteristic set as a target value of color calibration.

Figure 5A:
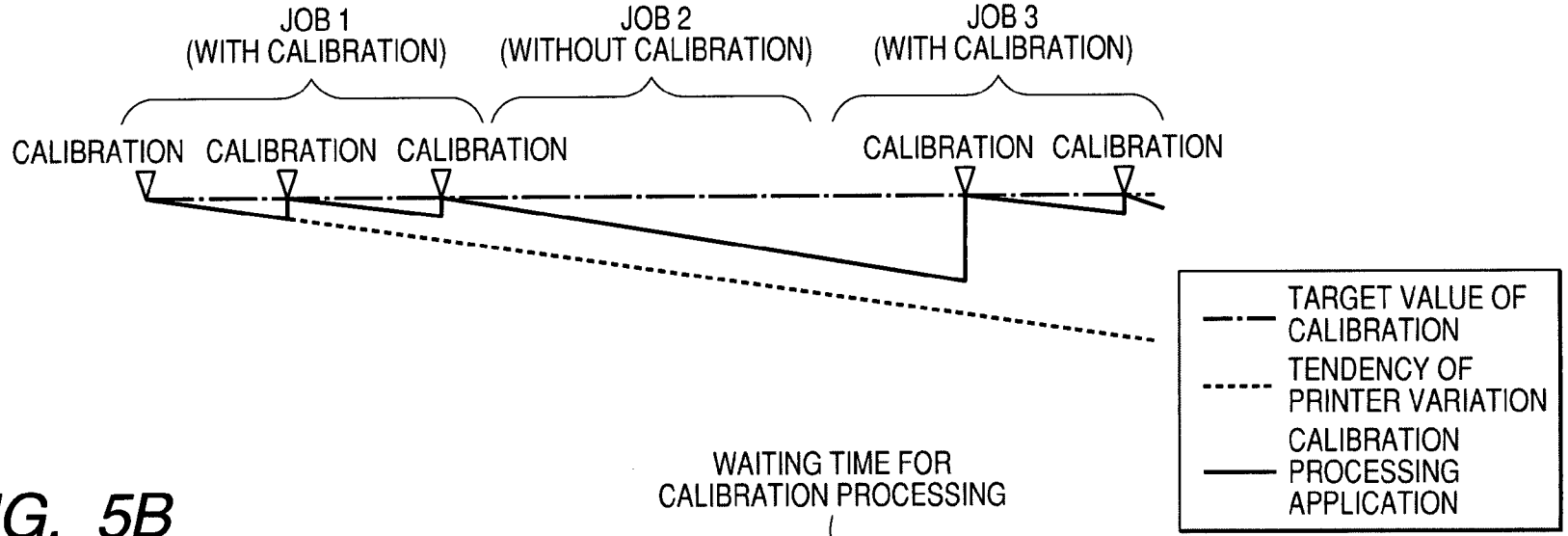
FIGS. 5A and 5B are charts for explanation of timing of color calibration in the printer 10.
Figure 5B:
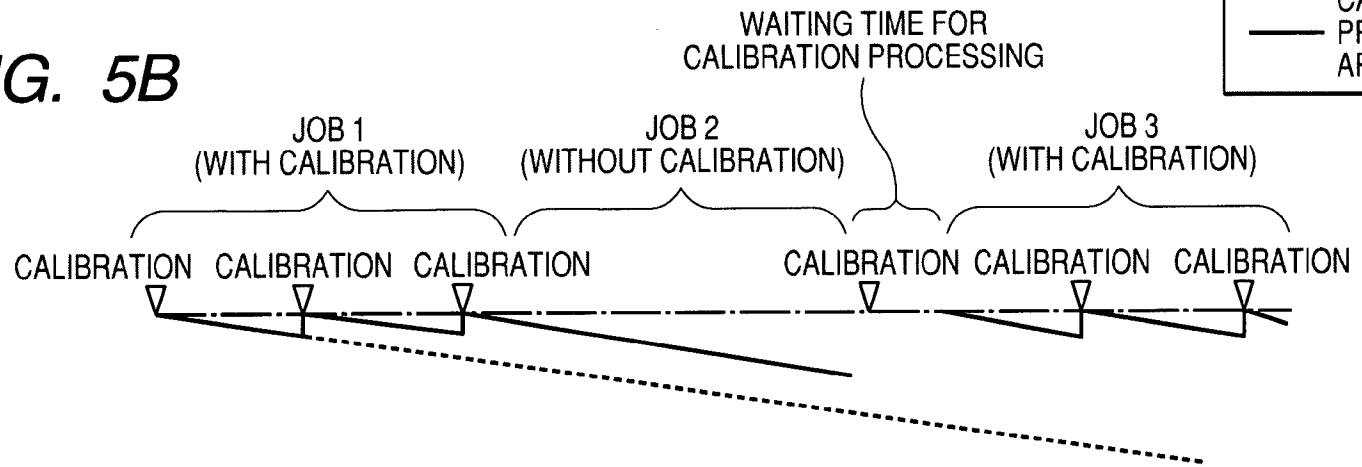

FIGS. 5A and 5B are charts for explanation of timing of color calibration in the printer 10, and FIG. 5A illustrates the case where the color calibration processing is performed regardless of the switching of jobs and FIG. 5B illustrates the case where the color calibration processing is performed in response to the switching of jobs.

As illustrated in FIGS. 5A and 5B, the printer 10 does not necessarily perform color calibration processing in every job. For example, color variation is hardly produced in the case of a job of monochrome printing because black (K) toner is used, and the printer 10 does not perform color calibration processing in the job.

Under such circumstances, as illustrated in FIG. 5A, if the printer 10 performs the empirical calibration processing regardless of the switching of jobs, color development characteristics are largely adjusted in "JOB 3", which results in highly visible color difference in the printed image.

Accordingly, as illustrated in FIG. 5B, the printer 10 in the embodiment minimizes the color variation during jobs by allowing the empirical calibration processing to interrupt when jobs are switched. Note that, in this example, color development characteristics are largely different between "JOB 2" and "JOB 3", however, because the recording paper or screen used in each job is different, the difference in color development characteristics between jobs is not significantly visible.

Further, as illustrated in FIG. 5B, in the case where continuous plural jobs are input, if the printer 10 allows the empirical calibration processing to interrupt when jobs are switched (between "JOB 2" and "JOB 3"), printing processing can not be performed during execution of the empirical calibration processing and thereby, the productivity is degraded. Therefore, it is desired that, in the case where the printer 10 performs the empirical calibration processing when jobs are switched, the printer does not perform the empirical calibration processing with respect to every combination of recording paper and screen, but performs the empirical calibration processing with respect to the specified combination of recording paper and screen only and applies the predictive calibration processing with respect to other combinations.

Figure 6:
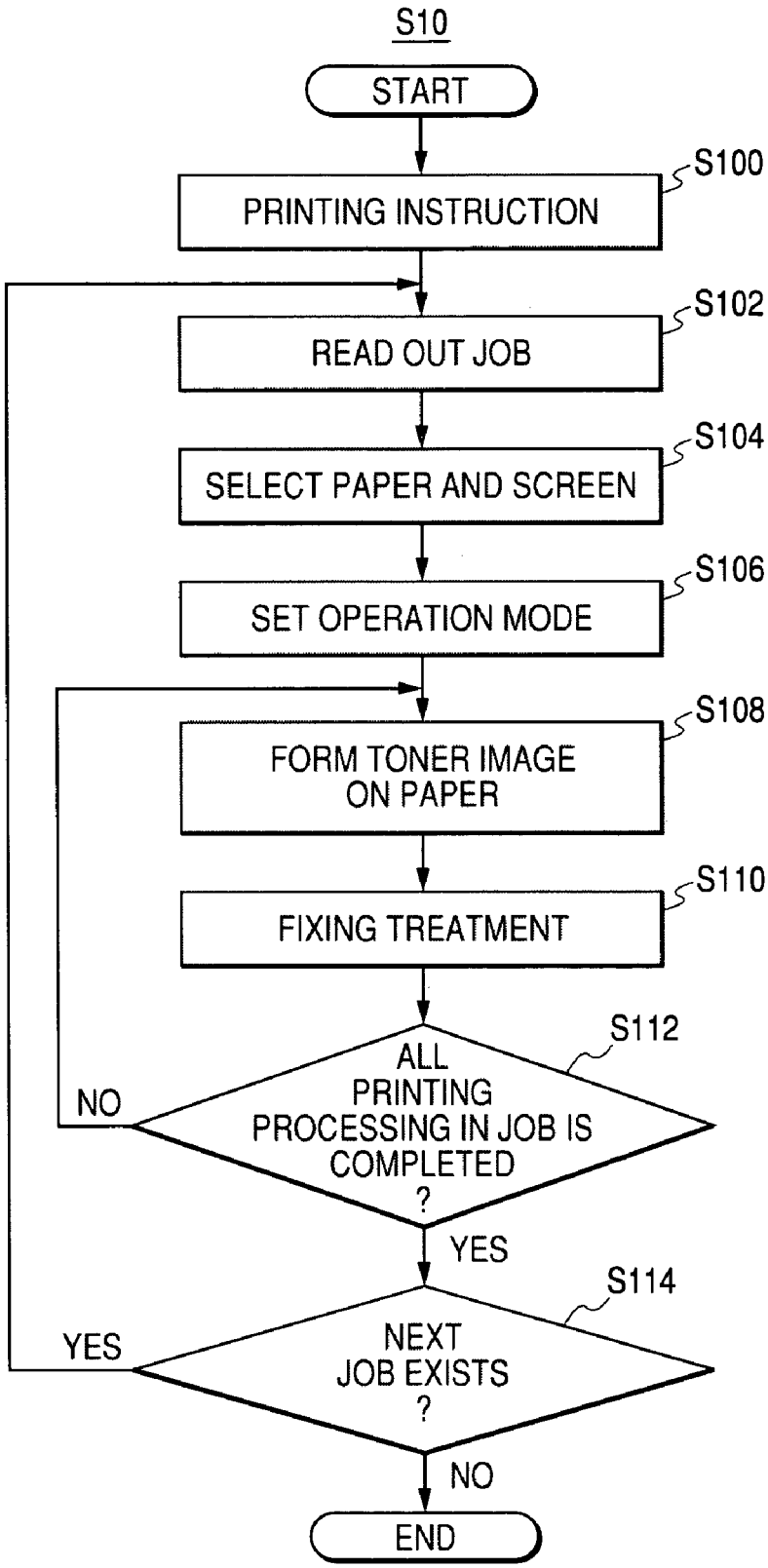
FIG. 6 is a flowchart for explanation of printing operation in the case where the printer 10 prints an image in response to the request of the user.

FIG. 6 is a flowchart S10 for explanation of printing operation in the case where the printer 10 prints an image in response to the printing request of the user.

As shown in FIG. 6, in step S100, the user performs printing request via a personal computer or a user interface device of the printer 10. When printing request data including at least one job is input, the data acquisition part 200 acquires and stores image data to be printed in response to the printing request of the user via a network or the image reading unit 12.

In step S102, the data acquisition part 200 reads out jobs included in the printing request data sequentially, outputs the image data of the read jobs to the image correction part 205, and outputs the mode defining information of the read jobs to the operation mode setting part 240 and the paper selection part 245.

In step S104, the image correction part 205 performs image quality correction processing such as tone correction on the image data input from the data acquisition part 200 and outputs the data to the screen processing part 215. At that time, the image correction part 205 determines the amount of correction by referring to the look-up table stored in the parameter storage part 210 in the image quality correction processing.

The screen processing part 215 selects a screen (e.g., dither matrix) based on the attributes (picture image, character image, line image, etc.) or additional information (tag data added to the image data or the like) of the image data input from the image correction part 205, binarizes the image data using the selected screen, and outputs the data to the writing control part 220.

Further, the paper selection part 245 selects the kind of recording paper 32 (i.e., paper tray 17) in response to the mode defining information input from the data acquisition part 200 and controls the paper tray 17 and the paper feed roller 18 to start the feeding of the recording paper 32.

In step S106, the operation mode setting part 240 sets the operation mode of the printer 10 based on the mode defining information (size of the recording paper, resolution of the output image, or the like) input from the data acquisition part 200, and thereby, designates the speed and timing of the operation to the image forming unit 14 and the intermediate transfer unit 16.

The image forming unit 14 and the intermediate transfer unit 16 start preparatory operation for performing printing processing in the set operation mode.

In step S108, the writing control part 220 controls the light scanning device 140 to write a latent image on the photoconductor drum 152. The latent image written on the photoconductor drum 152 is developed with toner by the developing device 156, and the developed toner image is multiple-transferred onto the intermediate transfer unit 16 is transferred onto the recording paper 32 in the secondary transfer position.

In step S110, the recording paper 32 having the toner image transferred thereon is carried to the fixing unit 19 and subjected to fixing treatment. The recording paper 32 that has been subjected to fixing treatment is discharged to the outside of the printer through the discharge path 187.

In step S112, the data acquisition part 200 judges whether the currently ongoing job is completed or not. That is, the data acquisition part 200 judges whether all of the images designated in the job have been printed or not, and, if the images designated in the job have been printed, moves to the processing in S114 and, in the case other than that, returns to the processing in S108 and repeats the printing of the images designated in the job.

In step S114, the data acquisition part 200 judges whether there is a subsequent job or not, and, if there is a subsequent job, returns to the processing in S102 and perform processing relating to the next job and, in the case other than that, ends the printing processing.

Figure 7:
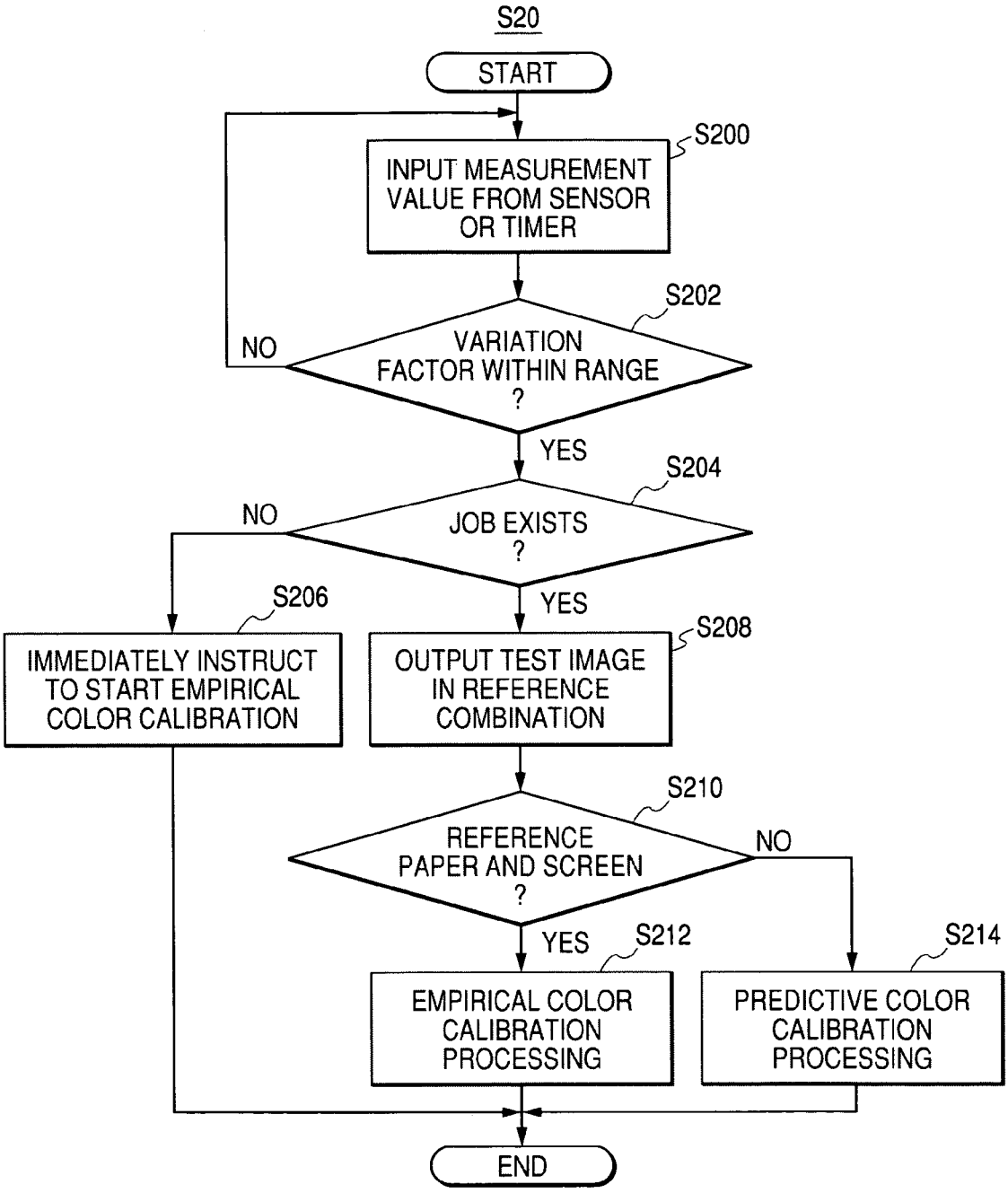
FIG. 7 is a flowchart for explanation of the operation when the printer 10 performs color calibration processing.

FIG. 7 is a flowchart S20 for explanation of the operation when the printer 10 performs color calibration processing. Note that each processing shown in this chart is performed in parallel with each processing shown in FIG. 6.

As shown in FIG. 7, in step S200, the factor monitor part 250 acquires output values from a timer for measuring the elapsed time, a counter for measuring the number of printed sheets, a remaining amount sensor for detecting the remaining amount of toner, an environment sensor for detecting the amount of environmental variations in temperature, humidity, or the like, a density sensor for detecting density of the toner image formed on the intermediate transfer belt 160, or the like with predetermined timing.

In step S202, the factor monitor part 250 judges whether the output value (i.e., color variation factor) falls within a predetermined range or not based on the input output value, and if it falls outside of the range, notifies the color calibration control part 260 to perform the empirical calibration processing, and, in the case other than that, prohibits the empirical calibration processing to the color calibration control part 260 and returns to the processing in S200 to continue the monitoring of the color variation factor.

In step S204, the color calibration control part 260 judges whether there is a job currently processed by the printer 10 or not, and, if there is a job, moves to the processing in S208 and, in the case other than that, moves to the processing in S206.

In step S206, color calibration control part 260 controls the data acquisition part 200 and the colorimetric sensor 189 to perform empirical calibration processing with respect to every combination of recording paper and screen. That is, when there is no proceeding job (e.g., immediately before starting jobs or in a period of waiting status), the color calibration control part 260 outputs a printing request of a test image to the data acquisition part 200 for prompt start of the empirical calibration processing. Further, the empirical calibration processing in the case is performed with respect to every combination of the kind of recording paper set in the paper tray 17 and the screen applicable by the screen processing part 215.

When the printing request of a test image is input, the data acquisition part 200 reads out the data of the test image from the test image storage part 270. Subsequently, the printer 10 prints the test image with respect to every kind of recording paper 32 set in the paper tray 17 by the same processing as in the printing operation shown in FIG. 6.

In step S208, the color calibration control part 260 instructs the data acquisition part 200 to print a test image using a reference combination of recording paper and screen. The printer 10 prints the test image using the reference combination of recording paper and screen in response thereto.

In step S210, the color calibration control part 260 judges whether a subsequent job uses the reference combination of recording paper and screen or not, and, if the reference combination is used, moves to the processing in S212 and, in the case other than that, moves to the processing in S214. Here, the reference combination is a combination of recording paper and screen that is frequently applied to the printing processing, or a combination of recording paper and screen that has been selected according to the instruction of the user, and used as a target of the empirical calibration processing in response to the switching of jobs. On the other hand, in the case of a combination of recording paper and screen other than the reference combination, it is used as a target of the predictive calibration processing. Note that the predictive calibration processing is performed based on the calibration value determined to the reference combination.

Thus, the printer 10 performs the empirical calibration processing only on the representative combination of recording paper and screen after jobs start, and thereby, suppresses the degradation of productivity.

In step S212, the color calibration control part 260 instructs the color calibration part 230 to perform the empirical calibration processing between the ongoing job and the subsequent job. The color calibration part 230 performs the empirical calibration processing between the ongoing job and the subsequent job in response thereto. Specifically, the test image detection part 232 extracts the amount characteristic of the test image printed in S208 and outputs the extracted amount of characteristic to the calibration value determination part 234. The calibration value determination part 234 determines a calibration value based on the amount of characteristic input from the test image detection part 232 and updates the look-up table within the parameter storage part 210 in response to the calibration value.

In steps S214, the color calibration control part 260 instructs the calibration value determination part 234 to perform predictive calibration processing. The color calibration part 230 performs predictive calibration processing based on the amount of characteristic input from the test image printed using the reference combination in S208. Specifically, the test image detection part 232 extracts the amount of characteristic from the test image printed using the reference combination and outputs the extracted amount of characteristic to the calibration value determination part 234. The calibration value determination part 234 predicts the amount of color variation based on the amount of characteristic input from the test image detection part 232 (the reference value relating to the current reference combination) and the amount of characteristic input from the test image detection part 232 immediately before the job starts (in S206), determines a calibration value to be applied to the subsequent job based on the predicted amount of color variation and the calibration value determined with respect to the combination of the subsequent job (the recording paper and screen used in the subsequent job) immediately before the job starts (in S206) (that is, the result of the nearest empirical calibration processing that has been performed with respect to the combination of the subsequent job), and updates the look-up table within the parameter storage part 210.

As described above, since the printer 10 in the embodiment allows color calibration processing to interrupt in response to the switching of jobs when plural jobs to be continuously processed are input, color difference produced before and after the color calibration can be made less visible.

Further, the printer 10 monitors the factor of color variations and performs color calibration processing only when the factor of color variations exceeds the acceptable range, and thereby, the printer can suppress the degradation of the productivity due to color calibration processing.

Further, when a job is input, the printer 10 performs empirical calibration processing only on the reference recording paper and screen and performs predictive calibration processing on other recording paper and screens, and thereby, the printer can suppress the degradation of the productivity due to empirical calibration processing.

Next, the second embodiment will be described.

As described in the first embodiment, in the printer 10, when the empirical calibration processing is allowed to interrupt simply when images are printed continuously, the test image is printed on the recording paper 32 and thereby the productivity (i.e., printing speed) is degraded.

Accordingly, the printer 10 in the embodiment suppresses the productivity degradation due to empirical calibration processing by performing at least a part of the empirical calibration processing performed for the subsequent job in parallel with the currently ongoing job. Note that "performed in parallel" includes the case where the ongoing job is suspended and a part of the empirical calibration processing is allowed to interrupt (interruption processing in the case where the same resource is commonly used), and the case where the empirical calibration processing is performed simultaneously with the ongoing job (parallel processing using independent resources, respectively).

Figures 8A, 8B:
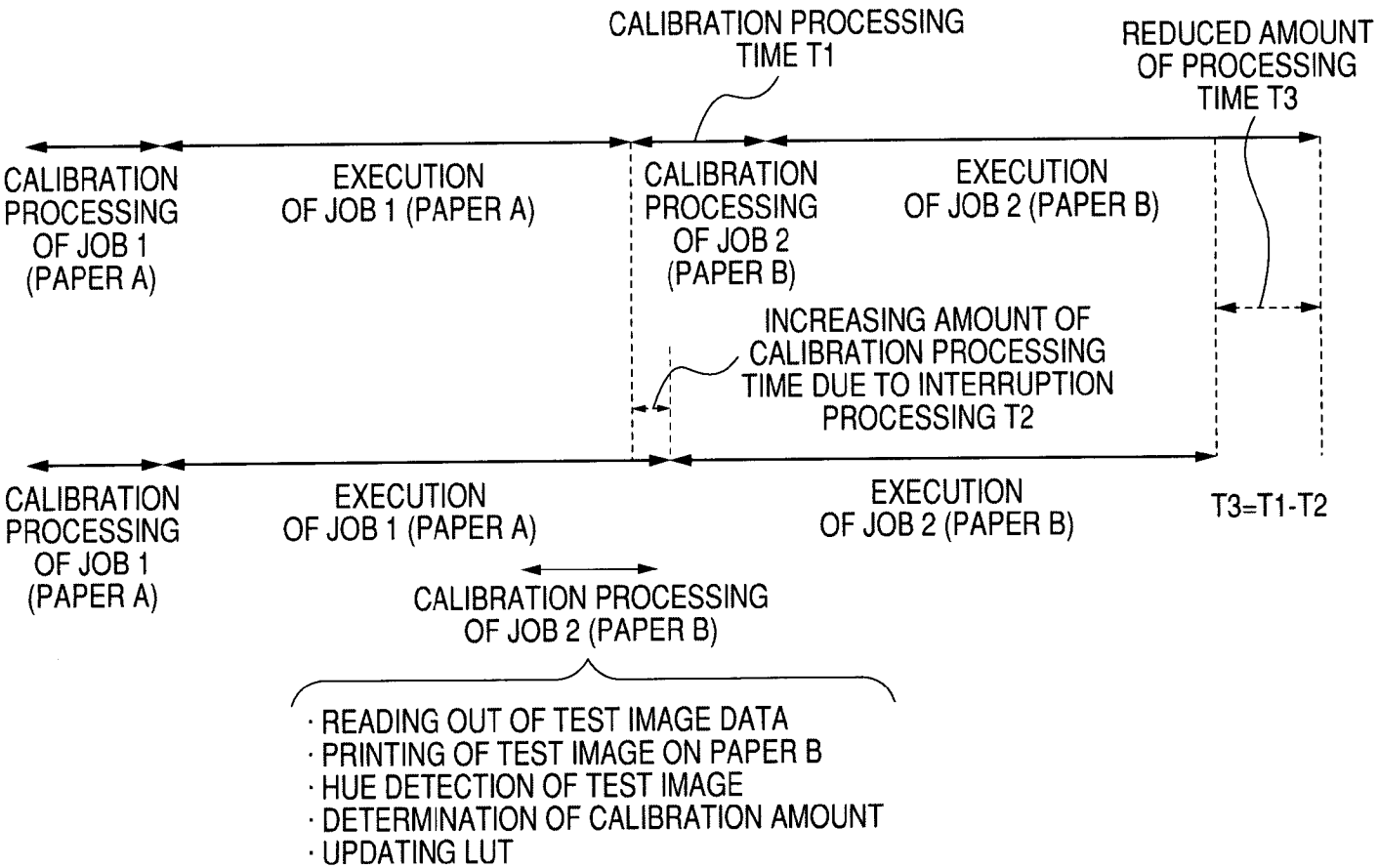
FIGS. 8A and 8B are charts for explanation of empirical calibration processing scheduled by the color calibration control part 260 in the second embodiment.

FIG. 8 is a chart for explanation of empirical calibration processing scheduled by the color calibration control part 260 in the second embodiment. In this example, the job 2 is a target of the empirical calibration processing, and the empirical calibration processing is needed to be completed before the job 2 is started.

As shown in FIG. 8, when the job 1 prior to the job 2 as a target of the empirical calibration processing is performed, the color calibration control part 260 allows at least one of reading out of the test image by the data acquisition part 200, toner image formation of the test image by the writing control part 220, the image forming unit 14, etc., secondary transfer of the test image (toner image) by the intermediate transfer unit 16 etc., fixing treatment of the test image (toner image) by the fixing unit 19, reading of the test image by the calorimetric sensor 189, calculation of the calibration value based on the test image by the calibration value determination part 234, and updating of the look-up table by the calibration value determination part 234 to be performed. For example, the color calibration control part 260 instructs the data acquisition part 200 to allow the printing processing of the test image in the empirical calibration processing to interrupt the preceding job 1. The data acquisition part 200 reconstructs the job in response thereto and allows the printing processing of the test image with the recording paper and screen used in the subsequent job to interrupt the preceding job.

Thereby, since the printer 10 can start the next job by performing a part of processing included in the empirical calibration processing (e.g., reading of the test image by the data acquisition part 200, reading out of the test image by the colorimetric sensor 189, or calculation of the calibration value based on the test image by the calibration value determination part 234) in parallel with the job 1, and performing only the updating of the look-up table by the calibration value determination part 234 when the jobs are switched, the printer can suppress the degradation of the productivity due to empirical calibration processing. Specifically, processing time of the job 1 increases (referred to as "increasing amount T2") by being interrupted by at least a part of the empirical calibration processing, however, because almost all of the empirical calibration processing (processing time T1) such as calculation of the calibration value can be performed in parallel with the job 1, the entire processing time until the job 2 is ended is shortened (reduced amount T3).

As described above, the printer 10 in the second embodiment can suppress the degradation of the productivity due to empirical calibration processing by allowing at least a part of the empirical calibration processing to interrupt the preceding job to perform parallel processing. Further, in the case where the parallel processing is performed so that a large part of the empirical calibration processing may be completed when the preceding job is ended (that is, before the job as a target of the empirical calibration processing is started), because the degradation of the productivity due to empirical calibration processing can be suppressed sufficiently, the printer 10 can perform empirical calibration processing at every time when jobs are switched. Since the accuracy of the empirical calibration processing is higher than that of the predictive calibration processing, the color of the image to be printed can be made more stable.

Next, the third embodiment will be described.

In the printer 10, as described in the second embodiment, when at least a part of the empirical calibration processing is incorporated in the preceding job, the operation mode is sometimes different between the preceding job and the printing processing of the test image in the empirical calibration processing. For example, the toner image formed in the preceding job is different in size from the toner image formed in the printing processing of the test image (incorporated in the preceding job), the intervals on the intermediate transfer belt 160 or the rotational speed thereof is required to be adjusted. Further, in the case where the resolution of the image output in the preceding job is different from the resolution of the image output in the printing processing of the test image, the writing speed (blinking speed) of the light scanning device 140 or the rotational speed of the photoconductor drum 152 is required to be adjusted. Thus, in the printer 10, in the case where one job is divided to allow the empirical calibration processing interrupt in the different operation mode, the control becomes complicated and much time is required for stabilization of the rotational speed of the intermediate transfer belt 160 etc. in response to the switching of operational modes, and thereby, the productivity may be degraded.

Accordingly, when selecting the recording paper used for the empirical calibration processing, the printer 10 in the embodiment selects recording paper at least having approximate surface characteristics to the recording paper used in the job as a target of empirical calibration processing so that the test image printing can be performed in the same operation mode as that in the preceding job.

Figure 9A:
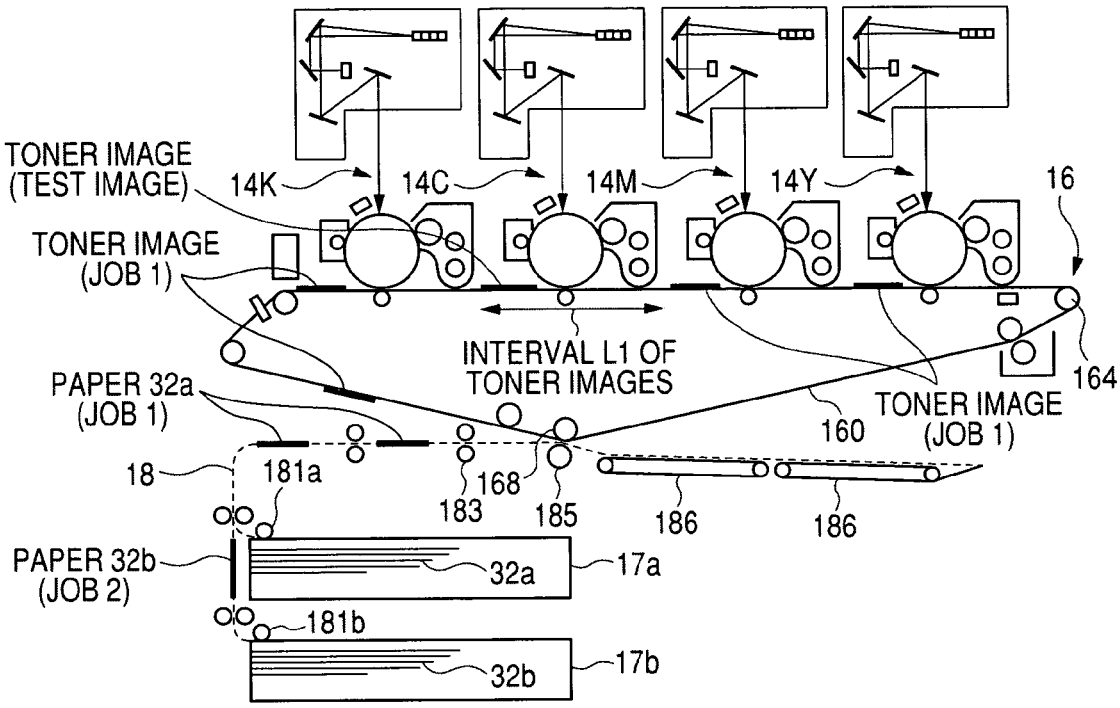
FIGS. 9A and 9B are explanatory diagrams of the relationship between an operation mode and the size of a test image or the size of recording paper, and FIG. 9A explains the relationship between the length of the test image in the sub-scanning direction and the intervals of toner images in a fixed operation mode and FIG. 9B explains the relationship between the intervals of toner images and the length of the recording paper 32 in a fixed operation mode.
Figure 9B:
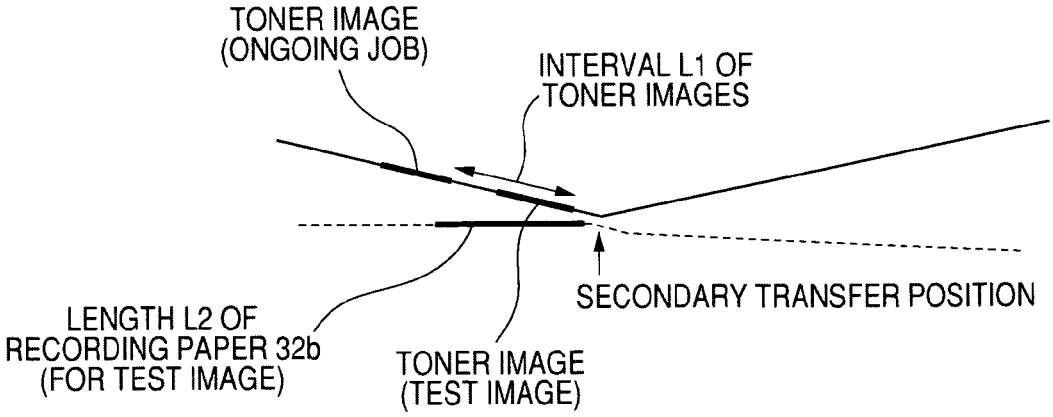

FIGS. 9A and 9B are explanatory diagrams of the relationship between an operation mode and the size of a test image or the size of recording paper, and FIG. 9A explains the relationship between the length of the test image in the sub-scanning direction and the intervals of the toner images in a fixed operation mode and FIG. 9B explains the relationship between the intervals of the toner images and the length of the recording paper 32 in a fixed operation mode.

As shown in FIG. 9A, the image forming unit 14 and the intermediate transfer unit 16 transfer plural toner images at fixed intervals L1 onto the intermediate transfer belt 160 according to the set operation mode. The operation mode is set in response to the size of the toner image formed in the ongoing job (i.e., the size of the recording paper), and thereby, the writing timing of the light scanning device 140, the rotational speed of the intermediate transfer belt 160, or the like are determined.

Therefore, when the test image becomes longer than the interval L1 in the sub-scanning direction (the rotational direction of the intermediate transfer belt), unless the operation mode is switched, the printer 10 can not form the subsequent toner image. That is, the printer 10 is required to determine the size of the interrupting test image in response to the operation mode of the ongoing job.

Further, as shown in FIG. 9B, the toner image (for test image) carried by the intermediate transfer unit 16 is transferred onto the recording paper 32*b* that has been carried in the paper feed path 18 in the secondary transfer position in which the secondary transfer roll 185 is provided. Therefore, the toner image and the recording paper 32*b* are synchronized in the secondary transfer position, however, in the case where the length L2 (in the paper carrying direction) of the recording paper 32*b* for the test image is longer than the interval L1 (in the toner image carrying direction) of the toner images, the printer 10 can not transfer the subsequent toner image onto the subsequent recording paper. Therefore, the printer 10 is required to select the recording paper 32 on which the test image is printed in response to the operation mode of the ongoing job. Further, in order to ensure the accuracy of the empirical calibration processing, it is desired that the recording paper on which the test image is printed is approximate to or substantially matches with the recording paper used in the job as a target of empirical calibration processing at least in surface characteristics.

Accordingly, when selecting the recording paper used in the empirical calibration processing, the printer 10 in the embodiment selects the recording paper approximate to the recording paper used in the job as a target of empirical calibration processing at least in surface characteristics and the recording paper in size in response to the operation mode of the ongoing job (the interval L1 of the toner images transferred onto the intermediate transfer belt 160).

Thus, in the case where the printing processing of the test image in the empirical calibration processing is allowed to interrupt the preceding job, the printer 10 in the third embodiment can allow the printing of the test image to interrupt without switching operating mode by selecting the size of the test image and the recording paper for the test image in response to the preceding job. Thereby, even in the case where the printing processing of the test image in the empirical calibration processing is allowed to interrupt the preceding job, the control of the image forming unit 14 and the intermediate transfer unit 16 does not become complicated. Further, the degradation of the productivity due to switching operation mode can be prevented.

As below, the modified examples of the above described embodiments will be described.

As the first modified example, a form in which the printer switches the execution ratio of the empirical calibration processing to the predictive calibration processing in response to the selection of the user is conceivable. For example, when the user selects the productivity priority mode, the printer 10 makes the ratio of executing the predictive calibration processing higher than the case where the image quality priority mode is selected, and, when the user selects the image quality priority mode, the printer 10 makes the ratio of executing the empirical calibration processing higher than the case where the productivity priority mode is selected.

Thus, the printer 10 can reflect the will of the user to the printing processing by switching the execution ratio of the empirical calibration processing to the predictive calibration processing in response to the selection of the user.

Further, as the second modified example, a form in which the printer 10 prints an image to be printed and a test image on one piece of recording paper according to the instruction of the user is conceivable. For example, the printer 10 may print a test image on a peripheral portion (in an area to be cut off) of the recording paper on which an image is recorded in response to the instruction of the user.

For example, in the case where the kind of the recording paper is the same in the ongoing job and the subsequent job but only the screen is switched, the test image is printed on a peripheral portion being used in the ongoing job. That is, the data acquisition part 200 generates data in which the test image is disposed in the periphery of the image to be printed in response to the instruction of the user based on the image data of the ongoing job and the data of the test image and outputs the data to the screen processing part 215. The screen processing part 215 switches the applied screen between the area of the image to be printed in response to the instruction of the user and the area of the test image with respect to the data generated by the data acquisition part 200. That is, the screen processing part 215 applies the screen in response to the image in the area of the image to be printed in response to the instruction of the user and applies the screen used in the job as a target of empirical calibration processing in the area of the test image.

Thus, the printer 10 can suppress the degradation of the productivity due to printing processing of the test image by printing the image to be printed in response to the instruction of the user and the test image on one piece of recording paper.

As another modified example, in the embodiments, a job is segmented by the switching of the kind of the recording paper 32 and the screen, however, the job may be segmented arbitrarily in response to the instruction of the user. Specifically, when the user performs a printing request by designating the segmented point of the job, the data acquisition part 200 divides the jobs at the designated segmented point and performs color calibration processing at the divided segmented point of the job according to the control of the color calibration control part 260. Thereby, the printer 10 can set the timing of the color calibration processing according to the will of the user.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2003-402812 filed on Dec. 2, 2003 including specification, claims, drawings and abstract is incorporated herein by reference in its entirety.

What is claimed is:

1. An image forming apparatus comprising:

an image forming part that forms an image on a recording medium;

a first calibration part that performs color calibration processing based on the image formed on the recording medium;

a second calibration part that performs color calibration processing based on a reference value that has been determined in advance;

a medium supply part that supplies a recording medium selected from a plurality of kinds of recording media to the image forming part; and a controller that permits color calibration processing by the first calibration part when at least one kind of recording medium is supplied by the medium supply part, and that inhibits the color calibration processing by the first calibration part and permits color calibration processing by the second calibration part when at least another kind of recording medium is supplied by the medium supply part.

2. The image forming apparatus according to claim 1, wherein the second calibration part performs color calibration processing with a numerical value generated in the color calibration processing by the first calibration part as the reference value.

3. The image forming apparatus according to claim 1, wherein the image forming part continuously forms a plurality of images, and wherein the controller allows the first calibration part to perform color calibration processing before continuous image forming processing is started by the image forming part, and allows the second calibration part to perform color calibration processing when continuous image forming processing is being performed by the image forming part.

4. The image forming apparatus according to claim 3, wherein the image forming part continuously forms a plurality of images by continuously executing a plurality of units of processing in each of which at least one image is formed, and wherein the controller allows the first calibration part to perform color calibration processing with timing in response to switching of the units of processing executed by the image forming part, and allows the second calibration part to perform color calibration processing when the units of processing are being performed by the image forming part.

5. The image forming apparatus according to claim 1, further comprising:

an acquisition part that acquires at least image data for color calibration; and a carrying path that carries the recording medium on which the image has been formed by the image forming part, wherein the image forming part forms at least an image for color calibration on the recording medium based on the image data for color calibration acquired by the acquisition part, wherein the first calibration part has:

a detection part provided in the carrying path that detects an amount of characteristic of the image for color calibration based on the image formed on the recording medium; and a calibration value determination part that determines a calibration value of color calibration based on the amount of characteristic detected by the detection part.

6. The image forming apparatus according to claim 1, wherein image forming processing requested by a user is divided into a plurality of units of processing, wherein the image forming part sequentially executes the divided plurality of units of processing, and wherein the first calibration part performs at least a part of color calibration processing for a subsequent unit of processing in parallel with the unit of processing that is being executed by the image forming part.

7. The image forming apparatus according to claim 6, wherein the first calibration part has:

a detection part that detects an amount of characteristic of the image for color calibration based on the image formed on the recording medium; and a calibration value determination part that determines a calibration value of color calibration based on the amount of characteristic detected by the detection part, wherein the first calibration part performs at least one of detection processing by the detection part and calibration value determination processing by the calibration value determination part for the subsequent unit of processing in parallel with the unit of processing that is being executed by the image forming part.

8. The image forming apparatus according to claim 1, wherein image forming processing requested by a user is divided into a plurality of units of processing, wherein the image forming part allows processing of forming an image for color calibration used in color calibration processing for a subsequent unit of processing to interrupt the unit of processing that is being executed, and wherein the first calibration part performs the color calibration processing for the subsequent unit of processing based on the image for color calibration formed by the image forming part.

9. The image forming apparatus according to claim 8, wherein the medium supply part supplies recording paper used for the subsequent unit of processing when the image forming processing for color calibration is allowed to interrupt the unit of processing that is being executed.

10. The image forming apparatus according to claim 8, wherein the image forming part switches an operation mode of image formation in response to the kind of recording medium, and wherein the medium supply part supplies a recording medium depending on the operation mode in the unit of processing that is being executed and the kind of recording medium used in the subsequent unit of processing to the image forming part as a recording medium used for the image forming processing for color calibration.

11. The image forming apparatus according to claim 10, wherein the image forming part has an image carrier that carries the formed image to a position where the image is transferred onto the recording medium, wherein the image forming part switches at least one of a carrying speed of images by the image carrier and an interval between images carried by the image carrier as the operation mode, and wherein the medium supply part supplies a recording medium adapted to at least one of the carrying speed of images by the image carrier and the interval of images carried by the image carrier.

12. The image forming apparatus according to claim 1, further comprising a factor monitor part that monitors a variation factor for varying color development characteristics of the image formed on the recording medium, wherein the controller permits color calibration processing by the first calibration part when the variation factor monitored by the factor monitor part exceeds a predetermined range, and prohibits the color calibration processing by the first calibration part in the case other than that.

13. The image forming apparatus according to claim 1, wherein the image forming part forms a toner image of a plurality of colors on the recording medium and allows the formed toner image to be fixed on the recording medium, and wherein the first calibration part performs color calibration processing based on the image that has been subjected to fixing treatment.

14. The image forming apparatus according to claim 1, wherein the controller allows one of the first calibration part and the second calibration part to perform color calibration processing in response to a selection of the user.

15. An image forming apparatus comprising:

an image forming part that forms an image on a recording medium;

a calibration part that performs first color calibration processing based on the image formed on the recording medium and second color calibration processing based on a reference value that has been determined in advance;

a medium supply part that supplies a recording medium selected from a plurality of kinds of recording media to the image forming part; and a controller that permits the first color calibration processing with respect to at least one kind of recording medium supplied by the medium supply part, and inhibits the first color calibration processing and permits the second color calibration processing with respect to at least another kind of recording medium supplied by the medium supply part to the calibration part.

16. An image forming apparatus for executing image forming processing including a plurality of units of processing, the apparatus comprising:

an image forming part that forms a plurality of images by sequentially executing the plurality of units of processing;

a calibration part that performs color calibration processing based on an image formed on a recording medium; and a controller that controls the calibration part to perform at least a part of color calibration processing for a subsequent unit of processing in parallel with but not for a unit of processing that is being executed by the image forming part.

17. An image forming apparatus for executing image forming processing including a plurality of units of processing, the apparatus comprising:

an image forming part that forms an image on a recording medium by sequentially executing the plurality of units of processing;

a controller that controls the image forming part to allow forming processing of an image for color calibration used in color calibration processing for a subsequent unit of processing but not for a unit of processing that is being executed; and to interrupt the unit of processing that is being executed; and a calibration part that performs color calibration processing based on the image for color calibration formed on the recording medium.

18. A calibration method of an image forming apparatus for forming an image on a recording medium, the method comprising:

forming an image on a recording medium; and performing first color calibration processing based on the image formed on the recording medium with respect to at least one kind of recording medium, and performing second color calibration processing based on a reference value that has been determined in advance with respect to at least another kind of recording medium.

19. A calibration method of an image forming apparatus for executing image forming processing including a plurality of units of processing, the method comprising:

sequentially executing the plurality of units of processing; and performing at least a part of color calibration processing for a subsequent unit of processing in parallel with but not for a unit of processing that is being executed.

20. A calibration method of an image forming apparatus for executing image forming processing including a plurality of units of processing, the method comprising:

forming an image on a recording medium by sequentially executing the plurality of units of processing;

allowing processing of forming an image for color calibration used in color calibration processing for a subsequent unit of processing but not for a unit of processing that is being executed to interrupt the unit of processing that is being executed; and performing color calibration processing based on the image for color calibration formed on the recording medium.

* * * * *